United States Patent [19]

Wittek

[11] Patent Number: 4,457,228

[45] Date of Patent: Jul. 3, 1984

[54] ROLLING PLATEN IMPRINTER

[75] Inventor: Harry Wittek, Hicksville, N.Y.

[73] Assignee: Bartizan Corporation, Yonkers, N.Y.

[21] Appl. No.: 361,469

[22] Filed: Mar. 24, 1982

[51] Int. Cl.[3] ..... B41F 3/04

[52] U.S. Cl. ..... 101/45; 101/269

[58] Field of Search ..... 101/45, 56, 269–274

[56] References Cited

U.S. PATENT DOCUMENTS

| | | | |
|---|---|---|---|
| 3,272,120 | 9/1966 | Johnson | 101/269 X |
| 3,388,660 | 6/1968 | Wight | 101/269 |
| 3,405,634 | 10/1968 | Maul et al. | 101/45 |
| 3,482,512 | 12/1969 | Jung | 101/110 |
| 3,763,777 | 10/1973 | Brown | 101/269 |
| 3,810,424 | 5/1974 | Barbour | 101/269 |
| 3,862,598 | 1/1975 | Hawthorne | 101/269 |
| 3,865,026 | 2/1975 | Trout | 101/45 |
| 3,954,056 | 5/1976 | Barbour | 101/269 |
| 4,256,036 | 3/1981 | Sauerwein et al. | 101/45 |
| 4,261,261 | 4/1981 | Titmuss | 101/269 |
| 4,324,181 | 4/1982 | Maul | 101/269 |

*Primary Examiner*—Edward M. Coven

[57] ABSTRACT

An improved apparatus for imprinting characters embossed on cards comprising a substantially flat imprinting base having on its upper surface a plurality of printing elements including a card having embossed characters thereon; a platen carriage mounted on said base for reciprocal movement thereon; a first roller platen rotatably mounted on a first roller platen axle mounted in the platen carriage perpendicular to its direction of travel and a second roller platen rotatably mounted on a second roller platen axle mounted in parallel relation to the first axle; means for holding one of the roller platens in a lowered position capable of imprinting characters during travel over the base in one direction and simultaneously holding the other roller platen in a raised, idle position; automatic shifting means for shifting the raised idle roller platen into a lowered position at the limit of platen carriage movement and simultaneously raising the other roller platen; means for separately adjusting the vertical elevation of each of the roller platen axles to achieve a more uniform accurate printing from less accurate printing elements; and a charge printer mounted in the plane of the imprinting base comprising a plurality of digit wheels having raised digits on their rims; means for accurately and reliably rotating and holding each digit wheel in a position in which a selected digit faces upwardly for printing; and means for clearing the charge printer when the platen carriage has travelled over it.

8 Claims, 8 Drawing Figures

ROLLING PLATEN IMPRINTER

THE FIELD OF INVENTION

This invention is related to a printing apparatus having at least one roller platen travelling over multiple printing elements and more particularly to an apparatus having dual roller platens for printing forms from printing elements including embossed plates or cards, especially credit cards.

BACKGROUND OF THE INVENTION

A variety of "credit card" imprinters are now in use in which separate cards or plates having embossed characters thereon imprint a joined pile of forms called a "form set". In retail sales establishments a form set for recording information relating to a sales transaction may be imprinted with vendor information from a merchant plate and customer information from a credit card carried by the customer. These printers may also imprint other information such as the date of purchase. This type of printer may be of the portable variety which can be carried by the agent or employee of the vendor to the customer or may be located on a counter. It may be a heavier, more sophisticated charge printer for recording the amount of a business transaction as well as the date. In addition, similar printing devices are now used in banks to imprint deposit slips with the customer's name and account number.

In the past these printers have comprised a substantially flat, rectangular printing base on which the credit card, the merchant plate, and auxiliary printers for charge and date are mounted. A platen carriage, containing a single roller platen, travels over the printing base and impresses a form set with embossed characters from the merchant plate and credit card and from the date and charge printers. This type of printer device suffered from a number of disadvantages. First, it is difficult to get both merchant plate and credit card at the same height with respect to a single roller platen. Consequently, it is difficult to get the characters from both to print distinctly. Also, the printer must hold the form set in place without undue stress which might tear or damage the paper forms.

In U.S. Pat. No. 3,862,598 issued to Hawthorne, Jan. 28, 1975, a credit card printer device containing a platen carriage having dual rollers mounted side-by-side on the same axle is described. When the platen carriage travels in one direction across the imprinting case one roller platen, mounted loosely on the axle, is unable to imprint while the other roller, being rigidly fixed, is able to print. When the platen carriage travel ends and the direction of platen carriage motion is reversed, the loose, idle platen becomes the imprinting roller platen and the fixed imprinting platen becomes the idle platen. While this device partially cures the disadvantages previously described, it does not describe a credit card printing device of the counter set variety with accompanying charge printer. Furthermore, in the U.S. Pat. No. 3,862,598 both rollers are on the same axle and of the same radius making separate height adjustments due to differences in credit card or merchant plate thickness difficult or impossible. Also, the mechanism of U.S. Pat. No. 3,862,598 is somewhat complicated so that replacement of worn parts, such as roller platens, is comparatively difficult. Similar criticisms can be made of other devices of the prior art including U.S. Pat. No. 3,272,120 issued to D. W. Johnson, Sept. 13, 1966 and U.S. Pat. No. 3,340,800 issued to J. H. Gruver et al. Sept. 12, 1967.

The improved imprinting device of this invention contains a platen carriage having dual roller platens set on separate parallel roller platen axles each of whose heights is individually adjustable thus allowing a superior way of adjusting to the proper printing levels for the different printing elements, as well as permitting the use of printing surfaces requiring less accuracy than the aforementioned devices or other devices of the prior art. In addition, the positioning of the roller platens closer to the leading edge of the platen carriage facilitates a shorter base, since the device's printing sequence can be reversed earlier than on one which has the print rollers located in the center of the platen carriage.

SUMMARY OF THE INVENTION

In the improved printing apparatus of the present invention a platen carriage containing a first credit card roller platen and a second merchant plate roller platen, each mounted on separate, parallel roller axles, travels over an imprinting base having on its upper surface, a credit card holder and a merchant plate. Each roller platen axle is perpendicular to and presses upwardly on two horizontal axle arms which are not straight but segmented having at least one lower horizontal segment and one higher horizontal segment. When a roller platen axle abuts against the lower segment of its axle arms, the platen is held downwardly in position to imprint characters. But when a platen axle abuts against the higher segment of its axle arms, the platen is held idle so that it cannot imprint characters. A lever mechanism switches an axle from the lower segment of its axle arms to the higher segment of its axle arms when a shift lever, downwardly directed from the platen carriage, presses against either of two stops located at each end of the platen carriages' travel across the imprinting base. The height of each platen roller is individually controlled by adjusting axle arm set screws on which the axle arms press upwardly. This dual platen roller imprinting mechanism is comparatively easy to disassemble for service and part replacement and allows easy separate height adjustments for both credit card and merchant plate platens to achieve optimum printing quality on printing surfaces not necessarily requiring high accuracy.

This invention also contains an improved mechanism for setting the amount of purchase on a charge printer attached to the imprinting base. This printer comprises a plurality of adjacent digit wheels having raised digits on their rim and gear teeth attached in a circle on their side which engage a gear sector. A series of pivotally connected levers is used to rotate the gear sector thus positioning a digit wheel at a position determined by one of the levers. The gear teeth of the digit wheels are also engaged by spring-loaded detent levers to hold the digits in place during printing. To insure that digits from a previous charge do not appear on a customer's bill the novel printing device of this invention is equipped with an automatic clearing mechanism which returns the digit wheels to their zero position after the platen carriage travels over the charge printer to record the charge and nears the end of its travel. This mechanism includes a downwardly protruding cam mounted to one end of the platen carriage. This cam depresses the roller of a pivoted lever which disengages the detent levers from the gear teeth of the digit wheels to alleviate their spring loads for a smooth and effortless clearing motion, while a second set of interconnected levers, actuated by one of the roller guides on the platen carriage, forces a clearing bar oriented perpendicularly to the gear sectors to press against the gear sectors returning them and the digit wheels they are engaged with to their zero position just before the platen carriage comes to rest on its limit. An appropriately attached spring may be used to restore the clearing mechanism to its original condition when the platen carriage is moved away from the limit of its travel.

It is an object of this invention to provide an improved printing apparatus having multiple printing elements located at different positions on an imprinting base which has an improved mechanism for effortlessly and reliably returning at least one of the printing elements to zero after printing therefrom.

It is another object of this invention to provide a credit card printer which accurately and reliably prints characters from a credit card and merchant plate.

It is a further object of this invention to provide a credit card printer which does not skip or miss characters from a merchant plate or credit card even if the thickness of the credit card and merchant plate differ substantially.

It is also another object of this invention to provide an improved credit card printer having multiple printing elements located at different positions on an imprinting base which is comparatively simple and which can be easily serviced and maintained.

It is yet another object of this invention to provide a credit card printer having a more accurate and reliable charge printer for recording the amount of a sales transaction.

It is further an object of this invention to provide a credit card printer from which characters on both a merchant plate and a credit card are accurately and reliably printed and which has a more accurate and reliable mechanism for recording the amount of a sales transaction.

BRIEF DESCRIPTION OF THE DRAWINGS

The features and operation of this invention will now be made apparent by reference to the following drawings.

DETAILED DESCRIPTION

Figure 1:
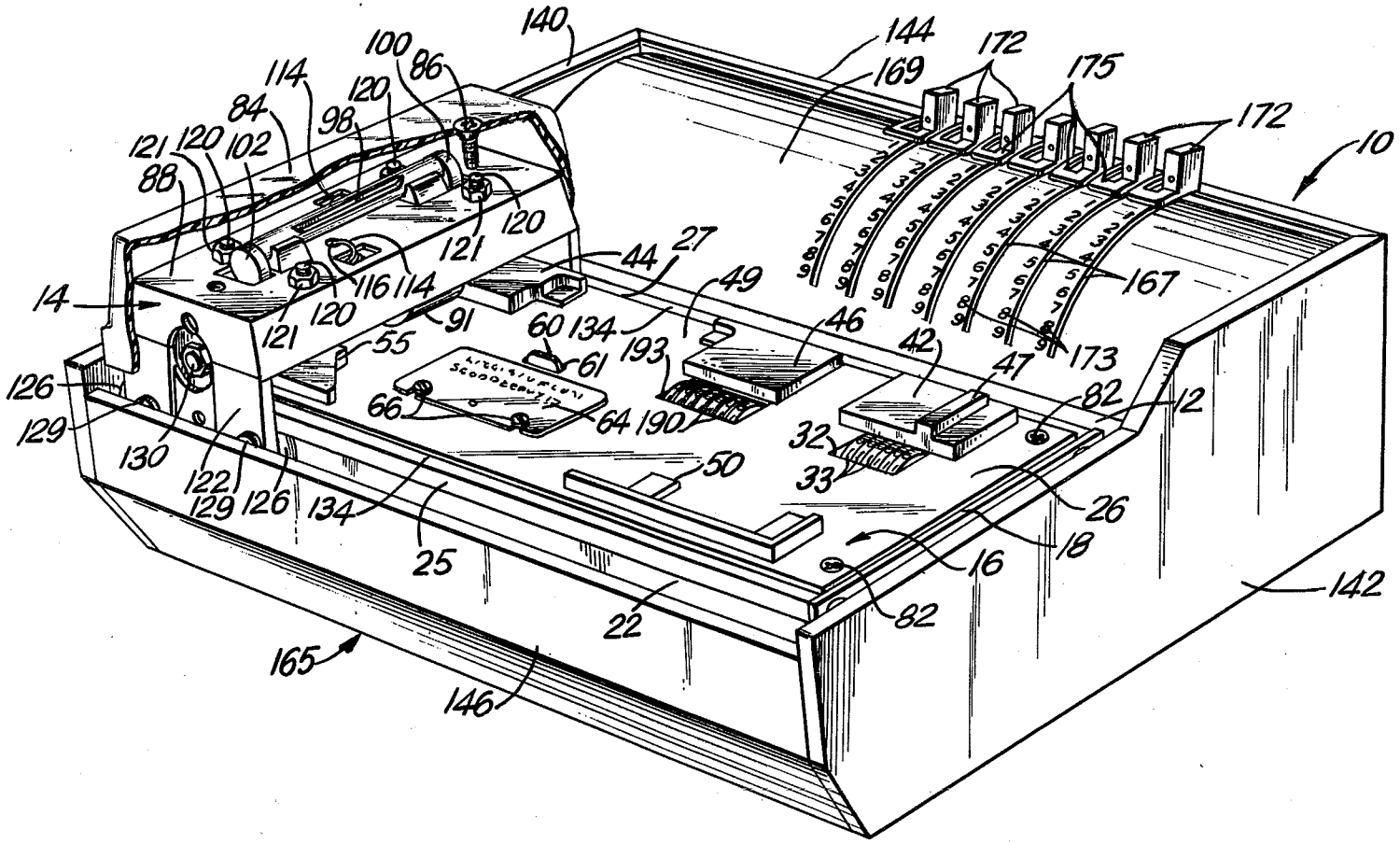
FIG. 1 is a top, prespective view of the improved credit card printer 10 of this invention.

In reference to FIGS. 1–8, the preferred embodiment of the imprinted credit card printer 10 of this invention comprises an imprinting base 16 for holding and supporting a first printing element, preferably a credit card, and a second printing element, merchant plate 64; a date printer 35 attached to and supported by the imprinting base 16; a charge printer 190 for printing the amount of the purchase and a platen carriage 14 mounted slidably on the imprinting base 16 having dual roller platens 91 and 90 which press the form set against the credit card, merchant plate 64, date printer 35 and charge printer 190 thereby printing charge amount, date, vendor and customer information on the form set.

In the preferred embodiment shown in the drawings, imprinting base 16 is substantially rectangular and comprises a first side rail 22, a second side rail 24 parallel to and of equal length with the first side rail 22 and a rectangular deck plate 26 connected flush with the top of the first side rail 22 and the top of second side rail 24. The top surfaces of side rails 22 and 24 each have a rectangular track 134. In the preferred embodiment the parallel, rectangular tracts 134 are grooves running the length of side rails 22 and 24. Platen carriage 14 travels across imprinting base 16 on vertical guide rollers 132 (see FIG. 3) which ride on and contact the tracks 134. The rollers 132 are preferably solid wheels rotatably mounted on eccentric hubs 130 attached to opposite sides of platen carriage 14. The ends of imprinting base 16 perpendicular to tracks 134 are covered by end pieces 18 and 20 (see FIG. 2). End pieces 18 and 20 are attached by screws to vertical rectangular end piece supports 19 and 21 respectively. End piece supports 19 and 21 are attached beneath deck plate 26 in opposite corners thereof by screws 82 passing through deck plate 26. End pieces 18 and 20 and end piece supports 19 and 21 are preferably plastic, but deck plate 26, side rails 22 and 24 are preferably an aluminum extrusion.

Credit card holder plates 46 and 44 comprise a credit card holder and are each attached near edge 27 of deck plate 26. Credit card holder plates 46 and 44 may take a variety of shapes, but must be so shaped and positioned on deck plate 26 so as to receive and hold a credit card in an opening 49.

The credit card is thus restrained from sliding off base 16 by abutting against holder plates 46 and 44. Credit card spring gauge 60 shown in FIGS. 1 and 2 retains the card in position when it is slid into pocket 49 to but against card holder plates 46 and 44. Credit card spring gauge 60 is a substantially flat piece of bendable metal having two portions, a larger flat portion attached beneath deck plate 26 by screw 62 and a smaller portion bent perpendicular to the portion beneath deck plate 26 and protruding through slot 61 in deck plate 26.

Spring guage 60 and slot 61 are a sufficient distance from edge 27 so that the credit card just fits between the portion of spring gauge 60 protruding through deck plate 26 and credit card holder plates 44 and 46. Spring gauge 60 is forced downwardly by the roller platen each time there is an imprint, to avoid the spring guage cutting through the form set.

As shown in FIG. 1, deck plate 26 has two rectangular openings, a charge printer opening 193 and a date printer opening 32, both positioned a distance from edge 27 equal to the distance from the embossed characters on the credit card to edge 27 when the credit card is set in place in credit card holder plates 44 and 43.

Merchant plate 64 is attached to deck plate 64, by screws 66, immediately below spring gauge 60.

The edge 25 of deck plate 26 has a trapezoidally shaped form set corner gauge 55 attached opposite to the edge of credit card holder plate 44 furthest from date printer opening 32. A substantially flat form set corner gauge 50 is attached to edge 25 opposite to date printer opening 32. Corner gauges 55 and 50 serve to guide and hold the form set to be imprinted. Corner gauges 55 and 50 may be of plastic and attached to deck plate 26.

Figure 2:
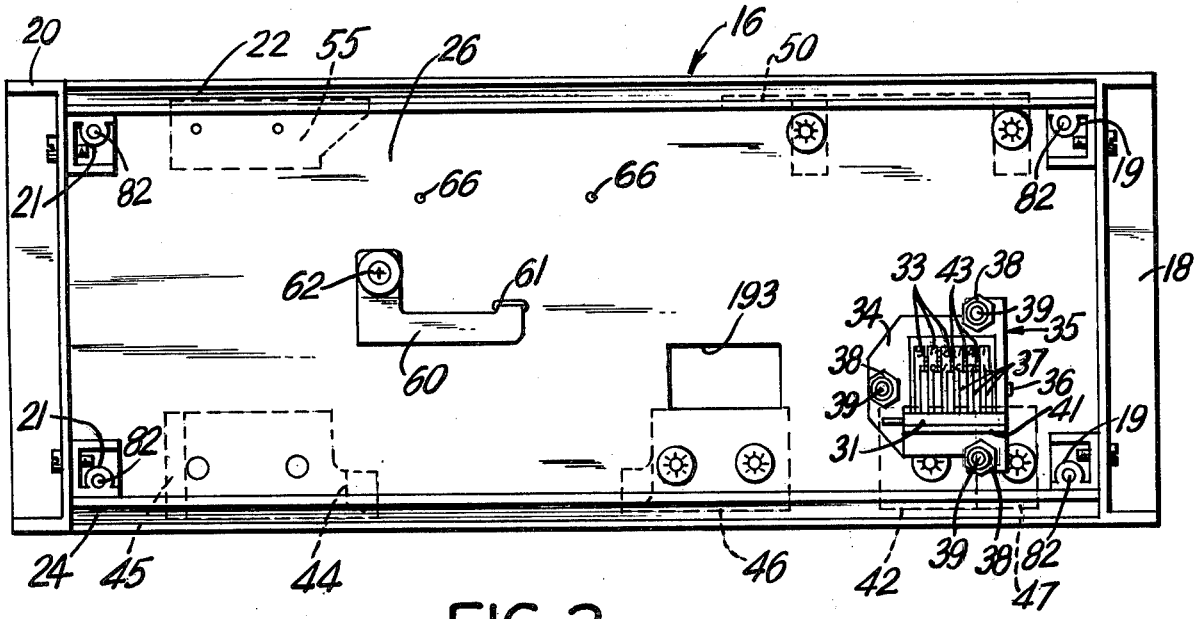
FIG. 2 is a bottom, plane view of the imprinting base 16 of this invention.
Figure 3:
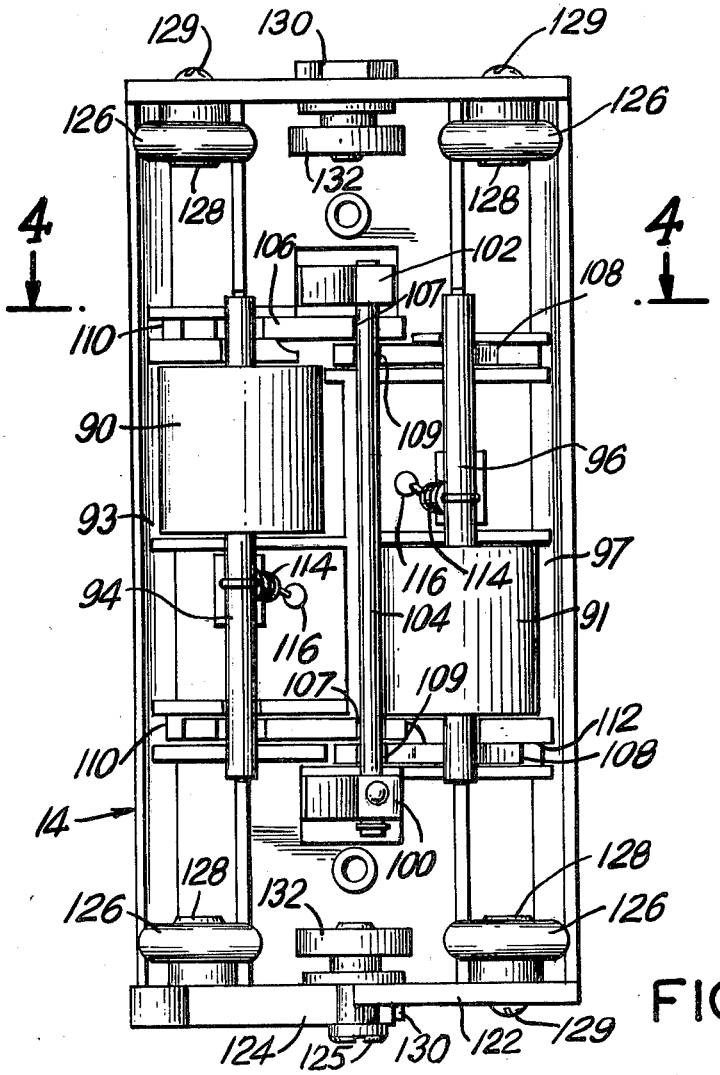
FIG. 3 is a bottom, plane view of the platen carriage 14 of this invention shown in FIG. 1.
Figure 4:
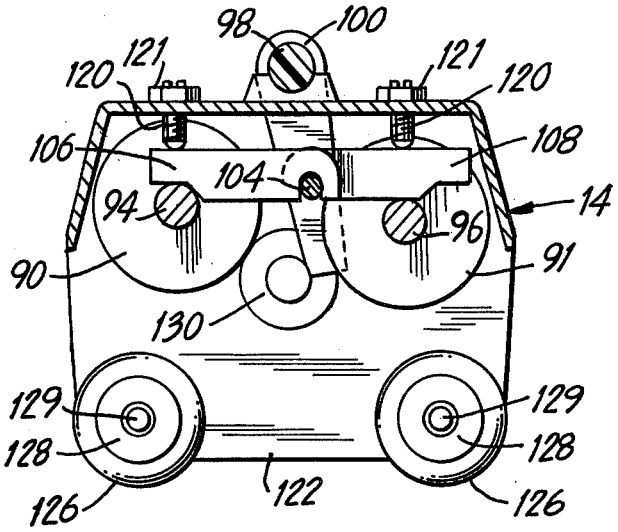
FIG. 4 is a sectional view of platen carriage 14 taken along line 4—4 of FIG. 3 showing roller platens 91 and 90 in their imprinting and idle positions respectively.
Figure 5:
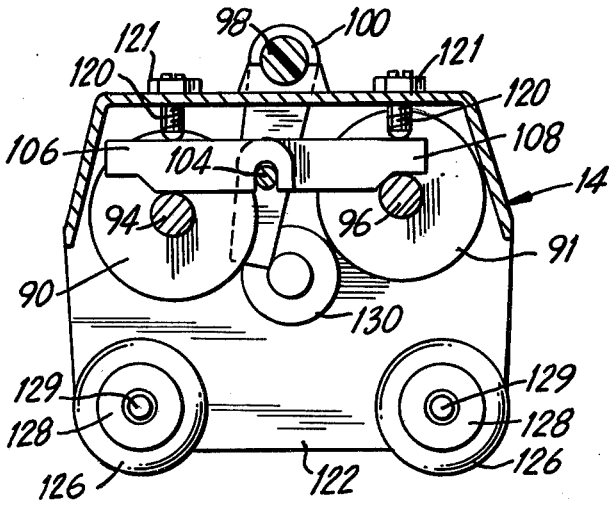
FIG. 5 is a sectional view of platen carriage 14 taken along line 4—4 of FIG. 3 showing roller platens 90 and 91 positioned in their imprinting and idle positions respectively.

Date printer 35 protruding through date printer opening 32 comprises preferably four or six circular date wheels 33 mounted on date printer shaft 35 set in date printer case 34 (see FIG. 2). Each date wheel 33 has raised digits from 0 to 9 on its rim. Each date wheel 33 is rotatable about shaft 36 so that the date may be set by hand. The ends of bolts 39 are press-fitted into the extrusion (deck plate 26). A coil spring is positioned around each bolt shaft and the coil springs urge the free-floating date frame against the adjusting nuts 38. The nuts 38 may be turned to adjust the date frame toward, or away from, the bottom face of the extrusion (deck plate 26). The date printer is adjusted so that its raised characters are at the same height as the embossed characters of the credit card or merchant plate. Each date wheel 33 has on its side a plurality of gear teeth 43 arranged in a circle. Each set of gear teeth 43 is engaged by a detent lever 37 attached perpendicularly to a detent lever support 41. The detent levers 37 and the detent lever support 41 are held in position so that the pointed tips of detent levers 37 engage gear teeth 43 by detent lever holder 31, an integral part of the date printer case 34. The detent levers 37 and detent lever support 41 are preferably of a bendable plastic. Thus, each date wheel 33 may be easily rotated so that a particular raised digit faces upward and is retained in that position during printing by the detent levers 37.

The novel platen carriage 14 of this invention, shown in FIGS. 3–8, comprises a first roller platen 91 and a second roller platen 90 mounted in carriage body 88. For imprinted flexibility the printing platen carriage 14 is structured so that the credit card, date printer 35, and charge printer 190 will imprint the form set when it is impressed by first roller platen 91 as platen carriage 14 passes over imprinting base 16 moving from the credit card toward date printer 35 and so that merchant plate 64 will imprint the form set when it is pressed by second roller platen 90 as platen carriage 14 moves back across imprinting base 16 from date printer 32 toward merchant plate 64.

Carriage body 88 is preferably of die-cast zinc alloy and has a cross-section shaped generally like that of a truncated isosceles triangle taken in the plane parallel to the direction of motion of platen carriage 14 across base 16. As shown in FIG. 1 carriage body 88 may be covered by a plastic cover 84 held by screws 86 which engage holes on top of platen carriage 14.

Platen carriage 14 is wider than imprinting base 16 and the ends of platen carriage 14 which extend beyond side rails 22 and 24 have attached at their bottom edges vertically oriented rectangular carriage side plates 122. Side plates 122 are integral with carriage body 88 and extend downwardly parallel to and partially covering the exterior surfaces of side rails 22 and 24. Cylindrical hubs 130 protrude interiorly through the top, center of side plates 122 and have eccentrically mounted thereon ring-shaped plastic vertical guide rollers 132 on which platen carriage 14 rolls across imprinting base 16 on tracks 134, except during imprinting. The hubs 130 may be turned to adjust the vertical spacing between platen carriage 14 and the base 16. During imprinting the platen carriage is lifted and there exists a small gap between the guide rollers 132 and their tracks 134.

Platen carriage 14 is horizontally stabilized in its motion across imprinting base 16 by a plurality of roller bearings 126. Roller bearings 126 are wheel shaped roller bearings each preferably being a nylon tire rotatably mounted on ball bearings to a metal hub 128. Roller bearings 126 are attached interiorly to side plates 122 by screws 129. Preferably the surface of the nylon tire is "U" or "V" shaped in cross-section so as to wedge itself, for centering, into its respective parallel "U" or "V" shaped channel along the bottom of deck plate 26 near the edges of the deck plate. The roller bearings 126 at each end of side plates 122 achieve horizontally stabilized motion of platen carriage 14 and bear the vertical pressure exerted by the roller platens 90,91 during imprinting. In those machines having charge clearing, the exterior surface of side plate 122 adjacent side rail 24 has attached to its lower edge, by screw 125, downwardly extending, preferably plastic charge setter clearing cam 124.

First roller platen 91, preferably a plastic cylinder with a cylindrical axle hole centrally located therein, is mounted rotatably on a first cylindrical roller platen axle 96 and is set in a nearly rectangular cavity 97 positioned parallel to and approximately one-quarter of the distance across the bottom face of carriage body 88 from the bottom edge of carriage body 88 closest to date printer 35. First roller platen 91 rotates in a nearly rectangular cavity 97 positioned so roller platen 91 passes over the credit card held in credit card holder plates 44 and 46, date printer 35 and charge printer 190. Second roller platen 90, otherwise identical to roller platen 91, is mounted on a second roller platen axle 94 positioned parallel to and about three-quarters of the distance from the bottom edge of carriage body 88 closest to date printer 35. Roller platen 90 is set in a nearly rectangular cavity 93 positioned in the bottom of carriage body 88 so that roller platen 90 passes over merchant plate 64. Axles 94 and 96 are held in grooves in vertical panels in carriage body 88. Axles 94 and 96 are held up by vertical retaining springs 114. Springs 114 are connected at their upper end to a spring support 116 (a hole in the top of carriage body 88) and to the approximate middle of first and second axles 96 and 94 at their lower ends.

Roller platen axle 96 abuts and presses against two axle arms 108 set into substantially rectangular axle arm cavities 112 positioned on either side of first roller platen 91. Similarly second roller axle 94 abuts and presses against two axle arms 106 set in axle arm cavities 110 set on either side of roller platen 90. Axle arms 106 and 108 are not straight but preferably consist of two approximately equal straight segments, horizontally oriented and connected by a short nearly vertical central portion. Both axle arms 106 and 108 are higher at their ends adjacent to the edges of the bottom of carriage body 88 than at their ends adjacent to the center of the bottom face of carriage body 88. Thus, if axles 94 or 96 rest on the higher straight portion of axle arms 106 or 108 roller platen 90 or 91 is raised idle so as to be unable to imprint, but if axles 94 or 96 rest on the lower straight portion of axle arms 106 or 108 roller platen 90 or 91 is lowered so as to be able to imprint.

Axle arms 106 and 108 press upwardly on axle arm screws 120 which can be used to adjust the height of roller platens 90 and 91. Axle arms 106 and 108 have coincident notches 109 and 107 located on their bottom surface near their ends adjacent to the center of the bottom face of carriage body 88. A shift lever shaft 104 passes horizontally through notches 107 and 109 (see FIG. 3). The end of shift lever shaft 104 closest to side rail 24 passes through the tip of tapered but nearly rectangular platen shift lever 100 (rocker arm) which protrudes downwardly through a hole in the top of carriage body 88. The other end of shift lever shaft 104 passes through, and is rigidly attached to, shift lever balance post 102 (rocker arm) which protrudes downwardly from another hole in the top of carriage body 88. On the top of platen carriage body 88 a cylindrical shift lever beam 98 passes, is held rotatably and is rigidly attached perpendicularly to the upper ends of shift lever balance post 102 and shift lever 100, (see FIG. 1). Shift lever 100, shift lever balance post 102 and shift lever beam 98 are preferably plastic. The holes through which balance post 102 and shift lever 100 pass downwardly are wide enough so that there are two resting positions for horizontally disposed shift lever shaft 104, one where shift lever shaft 104 is closest to second platen roller 90 and second axle 94 rests on the lower central portions of axle arms 106 (see FIG. 7); the other where shift lever shaft 104 is closest to first roller platen 91 and first axle 96 rests on the lower central portions of axle arms 108 (see FIG. 7). The edge of credit card holder plates 44 and 46 closest to date printer 35 has a rectangular, vertically oriented stop 47 which is of sufficient height and distance from edge 27 of deck plate 26 so that as platen carriage 14 moves toward stop 47 shift lever 100 abuts against stop 47 and is forced to be closest to roller platen 90. Thus, roller platen 90 becomes the imprinting roller when shift lever 100 abuts against vertical rectangular stop 47. When platen carriage 14 is moved from rectangular stop 47 across the credit card holder plates 44 and 46, it will be stopped by rectangular vertically oriented stop 45 of sufficient height and distance from edge 27 so as to engage shift lever 100. Stop 45 is held on to deck plate 26 (see FIG. 2) and is preferably plastic. When the stop 45 engages shift lever 100 roller platen 91 is forced into a lowered imprinting position while seconed roller platen 90 is set in a raised, idle position.

Figure 6:
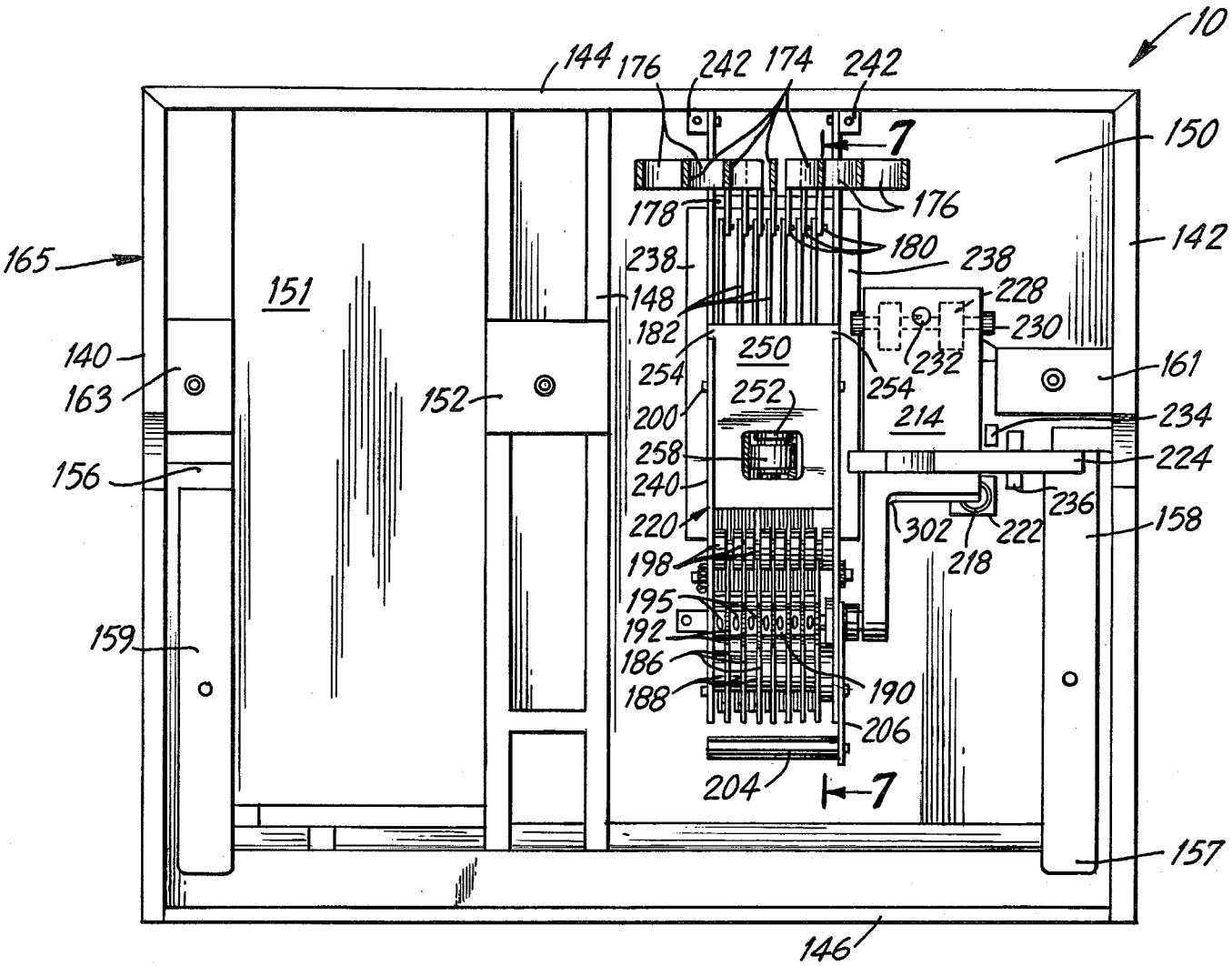
FIG. 6 is a top, plane view of the improved credit card printer 10 of this invention with imprinting base 16 and platen carriage 14 detached and removed therefrom.

Imprinting base 16 and charge setter 220 are conveniently supported by a case 165 having a floor 150, case side walls 140 and 142, a case front wall 146 and a back wall 144 (see FIG. 6). The charge setter 220 mounted on floor 150 is separated conveniently from a storage compartment 151 by interior wall 148. Front wall 146 is approximately rectangular but of smaller height than rectangular back wall 144. Side walls 140 and 142 and interior wall 148 advantageously have the same shape and size and are of a greater height where attached to back wall 144 and of lower height where attached to front wall 146. Storage compartment 151 is preferably used for form sets and the like.

Side walls 140 and 142 are reinforced with rectangular base supports 156 and 158 attached interiorly to side walls 140 and 142 and set against front wall 146. Rectangular base supports 156 and 158 have in their top surfaces ledges 159 and 157 respectively. Ledges 157 and 159 are of sufficient width and length to receive end pieces 18 and 20 and thus to hold imprinting base 16 in position.

Charge setter 220 shown in the above FIGS. 6–8 and 1 is a novel mechanism for setting charge printer 190 shown in FIG. 1 protruding through charge printer hole 193. The charge printer 190 is set by the vendor by setting digit setter window handles 172 attached to window handle setting lever 176 so that the appropriate digit 173 shows through rectangular windows 175. Setting levers 176 slide through digit cover 169 in lever slots 167. As shown in FIGS. 1 and 6 curved digit cover 169 rests on rectangular, horizontally oriented digit cover support 12 supported at one end by support piece 163 adjacent to base support 156 and at the other end by rectangular cover support post 161 attached adjacent to base support 158 on side wall 142.

Charge printer 190 comprises advantageously seven circular digit wheels 195 rotatably mounted on digit shaft 191 passing through a central axial hole in each wheel 195. Each digit wheel 195 has raised digits on its rim. A plurality of gear teeth 192 shaped to form a gear are mounted on one side of the digit wheels 195. Digit shaft 191 (see FIG. 7) passes through and is supported by setter side walls 240. As shown in FIG. 6 charge setter 220 is held in position on case floor 150 by rectangular guide pieces 238 adjacent and parallel to side walls 240 and attached to floor 150. Charge setter 220 is also held in position by tabs 242 which slide into slots in the bottom of setter side walls 240 adjacent floor 150. Tabs 242 may be attached to floor 150 by bolts or screws.

Figure 7:
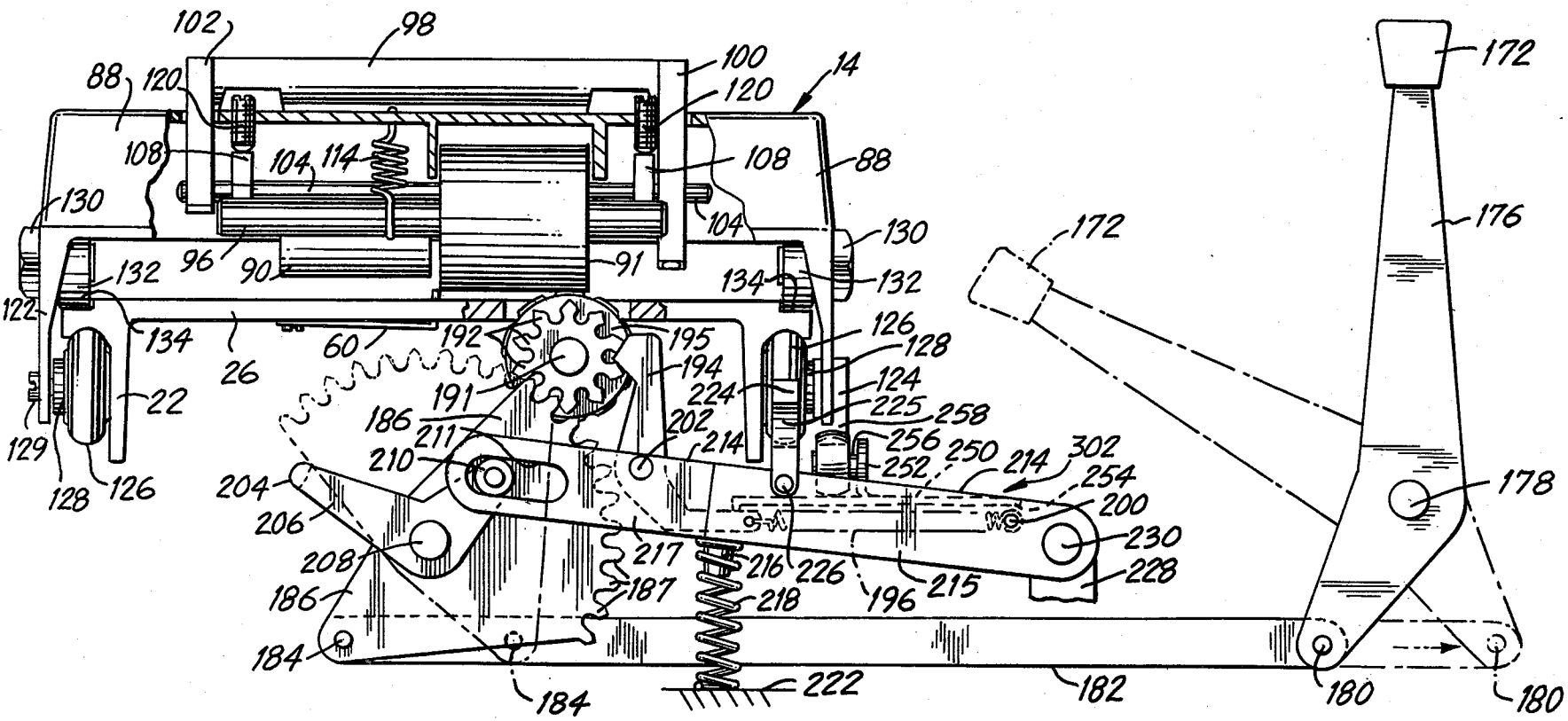
FIG. 7 is a detail section of charge setter 220 taken substantially on line 7—7 of FIG. 6 and also shows platen carriage 14.

The mechanism of charge setter 220 is shown in detail in FIG. 7. A digit wheel gear segment 186, shaped approximately like a segment of an ellipse, has a plurality of teeth 187 on the outer periphery of the ellipse which engage gear teeth 192 mounted on the side of digit wheel 195. Gear segment 186 pivots about a gear shaft passing through gear segment 186 approximately halfway between teeth 187 and a pivot pin 184. Pivot pin 184 is passed through one end of horizontally disposed link 182 and the base of gear segment 186 furthest from the teeth 187. Digit setter pivot pin 180 passes rotatably through the other end of rectangular link 182 and a digit setter lever 176. Digit setter lever 176 is upwardly directed and may be bent. At the vertex of the angle formed by two straight portions of digit setter lever 176, digit setter pivot shaft 178 passes through sector lever 176 and is supported by setter side walls 240 as shown in FIG. 6. As shown in FIGS. 1 and 6 a window handle 172 is attached to a vertically oriented window handle support blade 174 portion at the top of a digit setter lever 176. For convenient spacing of window handles 172 digit setter levers 176 may be bent in the direction of motion of platen carriage 14 away from the center of digit setter 220 as shown in FIG. 6.

To retain the digit wheels 195 in place after they are set, teeth 192 of the digit wheel 195 are engaged by substantially V-shaped detent levers 194. Detent levers 194 pivot on detent shaft 202 passing through the vertex of the angle formed by the two substantially straight portions of V-shaped detent levers 194. One end of detent lever 194 is narrowed and bent to engage teeth 192 of digit wheels 195 on the side opposite to that engaged by the teeth 187 of gear segment 186. The tail end of each detent lever 194 is attached to a horizontally disposed detent lever spring 196 which is secured at its other end to a spring shaft 200 supported by and passing through setter side walls 240 as shown in FIG. 6. As shown in FIG. 6, on the other side of detent lever 194 stop shaft 199 having a plurality of separation disks 198 thereon passes through and is supported by side walls 240. The shaft 199 limits the backward travel of the detent levers 194.

Figure 8:
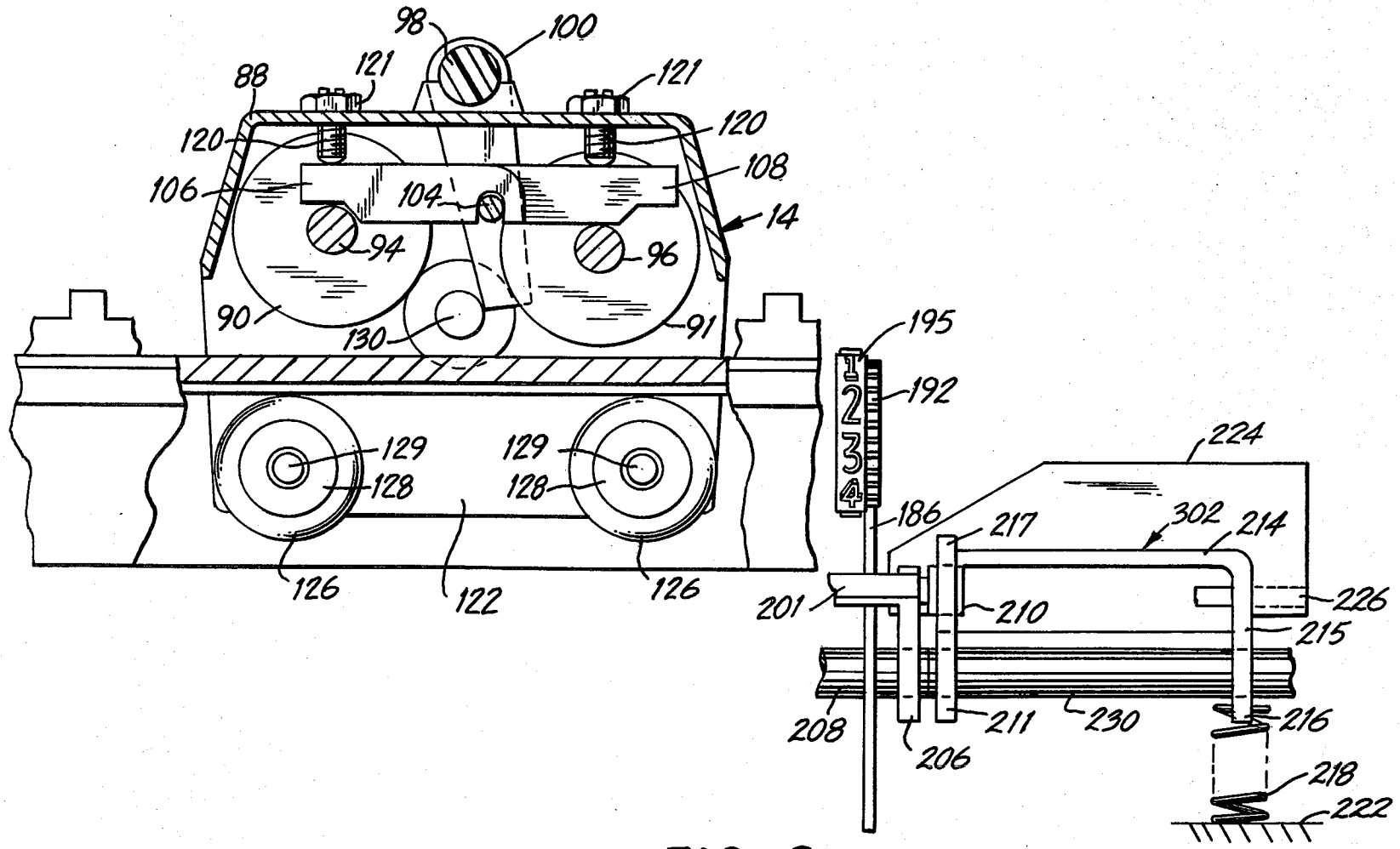
FIG. 8 is a partial cutaway view of the clearing mechanism for charge setter 220 shown in FIG. 6 and also shows platen carriage 14.

In addition to the digit setting mechanism, charge setter 220 also has an automatic clearing mechanism shown in detail in FIGS. 6–8. This clearing mechanism comprises a clearing lever 302 having a substantially rectangular bar plate 214. The opposite parallel long edges of bar plate 214 have narrow nearly rectangular perpendicularly and downwardly directed bar sides 215 and 217 attached thereto. Bar side 215 is the same length as bar plate 214, but bar side 217 extends beyond bar plate 214 and is adjacent and parallel to the setter side walls 240. The end of clearing lever 302 not having bar side 217 extended therefrom has passing through both bar sides 215 and 217 a clearing bar shaft 230. Clearing bar shaft 230 also is slidably mounted and rotates in a horizontally oriented hole through rectangular bar shaft mount 228 attached to floor 150. The clearing lever 302 is fixed to shaft 230 by a shaft screw 232 passing through bar plate 214. Thus, clearing lever 302 is rotatable on shaft 230 in mount 228. The bar side 217 extends from the end of clearing lever 302 and has a rounded tip having therein a nearly rectangular hole 211 with rounded ends. Directed downwardly and attached to the tip of bar side 215 is a metal spring post 216. Positioned on floor 150 immediately below spring post 216 in a cup 222 wide enough to hold the end of spring 218 which engages spring post 216 at its upper end, forcing the clearing lever 302 upwardly. A V-shaped flat clearing bar lever 206 is mounted in pivot 208 below, but near, the extended tip of bar side 217 on setter support wall 240. One arm of V-shaped clearing bar lever 206 is long enough to pass between the rounded tip of bar side 217 and setter side wall 240 and has attached perpendicularly a cylindrical shaft 210 with a cylindrical polyethylene sleeve 212, which with shaft 210 protrudes through slot 211 to engage clearing bar 204. The other arm of clearing lever 206 extends beyond the edge of setter side wall 240 and has at its tip attached perpendicularly a clearing bar 204 directed across the front of charger setter 220. Clearing bar 204 is somewhat wider than charge setter 240 and when spring 210 is not compressed it is substantially below and positioned away from the gears 186 in front of charge setter 220. Clearing lever 302 has a vertically oriented, preferably plastic, clearing lever yoke 224 shaped like an arch with two vertical yoke legs 225 and attached pivotally thereto by passing shaft 226 rotatably and horizontally through the downwardly directed yoke legs 225 and bar side 217 and 215. As seen in FIGS. 6–8 clearing lever yoke 224 slides against a first vertically directed rectangular yoke guide 234 when clearing lever yoke 224 is pushed down depressing clearing bar 302. A rectangular second yoke guide 236 is advantageously positioned laterally between bar side 215 and side wall 142. Yoke guide 234 is positioned adjacent yoke bar 225 between clearing bar 302 and yoke bar guide 236 laterally. Clearing lever yoke 224 is of sufficient height and is attached a sufficient distance from shaft 230 to clearing lever 302 so that roller guide 126 of platen carriage 14 shown in FIGS. 7 and 8 can abut against and push down clearing lever yoke 224 after platen carriage 14 travels over printer 190 printing therefrom.

A substantially rectangular detent lever release plate 250 shown in FIGS. 6 and 7 is used to disengage detent levers 194 from the gear teeth 192 of the digit wheels 195 after printing just prior to clearing the printer. The edge of detent plate 250 closest to and parallel to detent levers 194 has a downwardly directed lip which rests on the rails of detent levers 194. The edge of detent plate 250 parallel to the edge having the downwardly directed lip has horizontal extensions 254 which protrude beyond charge setter walls 240 and engage vertically oriented slots therein. Detent plate 250 pivots on extensions 254 and has a substantially rectangular hole approximately in its center. On the edge of the hole parallel to and adjacent to extensions 254 a rectangular detent roller support plate 252 is vertically directed. Support plate 252 has a support shaft 256 directed horizontally therefrom on which an actuating roller 258 is rotatably mounted in the central hole in plate 252. The roller 258 is so oriented and detent plate 250 is so positioned that when platen carriage 14 travels over the charge printer 190 clearing cam 124 shown in FIG. 7 attached to and protruding below side plate 122 can abut against the push down detent roller 258 and detent plate 250, disengaging detent levers 194 prior to and during the clearing by bar 204 for a smooth, effortless clearing.

In operation, a credit card is placed against card holder plates 46 and 44 and a form set is placed between and against corner guages 55 and 50. Platen carriage 14 is initially positioned so that shift lever 100 presses against rectangular stop 45 shown in FIG. 2 so that roller platen 91 is in its lowered position ready to imprint but roller platen 90 is in its idle position so that it cannot imprint.

The digit setter window handles 172 are then set at the appropriate digits 173 on cover 169 thus rotating digit setter levers 176. Link 182 is then pulled forward pivoting gear segment 186 and engaging teeth 187 in digit wheel teeth 192. Digit wheel 195 is thus turned to the appropriate digit forcing detent levers 194 backwards toward stop 198 until the appropriate digit faces upwardly. When digit wheel 195 stops rotating as window handle 172 reaches the appropriate position, spring 196 pulls the curved tip of detent lever 194 to re-engage digit wheel teeth 192 fixing the digit wheel 195 in position for printing. The date printer 35 is of a simpler construction and may be set by hand at the beginning of each day by rotating date printer wheels 33, but must be changed by hand.

Platen carriage 14 is then moved from stop 45 to stop 47 imprinting customer information from the credit card, the date from date printer 35 and the amount of the charge from charge printer 190. Shaft lever 100 abuts against vertical rectangular stop 47 forcing roller platen 91 up into its idle position and roller platen 90 down into its imprinting position as described above. As platen carriage 14 moves shift lever 100 toward stop 47 clearing cam 124 attached to side plate 122 abuts against and pushes down detent roller 258 and detent plate 250 disengaging detent levers 194. Then roller guide 126 abuts against and presses down clearing yoke 224 causing clearing bar 302 to pivot downwardly. As clearing bar 302 is forced down V-shaped clearing bar support 206 is pivoted clockwise about shaft 208 forcing clearing bar 204 upwardly to push protruding gear segments 186 back to their zero position thus clearing the charge printer 190. Platen carriage 14 is then moved back from stop 47 to imprint vendor information from merchant plate 64.

While the preferred embodiment of the novel credit card imprinting apparatus 10 has been described in detail above, it is to be understood that the invention defined by the scope of the claims appended below is not to be limited by particular details set forth in the description of the preferred embodiment especially by particular components utilized or by the manner in which the particular components cooperate when that cooperation is not material for the invention as set forth in the claims. For example, the number of springs required to hold the roller platen axles 94 and 96 are not critical to the practice of this invention and are not seen to limit the scope of the following claims.

What is claimed is:

1. An improved apparatus for imprinting characters embossed on cards comprising a substantially flat imprinting base having on its upper surface a first printing element comprising a card having characters embossed thereon; a platen carriage mounted for reciprocal movement on said base over said printing elements; a first roller platen and a second roller platen; a first roller platen axle rotatably mounting said first roller platen in said platen carriage; a second roller platen axle rotatably mounting said second roller platen in said platen carriage substantially parallel to said first axle and in side-by-side relationship; said first roller platen passing over and imprinting from said first printing element and said second roller platen passing over and imprinting from said second printing element; holding means for holding said first roller platen in a lowered position capable of imprinting characters during travel of said platen carriage over said card and for simultaneously holding said second roller platen in a raised, idle position; and shifting means automatically operated in one direction of travel of said platen carriage after said first roller platen passes over said first printing element for shifting and raised, second roller platen into a lowered position capable of imprinting characters and shifting said lowered platen roller simultaneously into a raised, idle position;

wherein said holding means includes two vertically oriented retaining springs, each of said springs being directly attached at their lower ends to each of said roller platen axles, a pair of substantially horizontal axle arms mounted on opposite sides of each of said roller platens, each of said axles being perpendicular to and being pressed upwardly by said springs against said axle arms, each of said axle arms being composed of a plurality of straight segments comprising a lower segment located adjacent to the center of said platen carriage and a higher segment located adjacent an edge of said platen carriage, said axle arms having coincident notches therein located adjacent to the center of said carriage platen; and said shifting means includes a vertically oriented shift lever shaft which is pivotally mounted on said platen carriage and pivotable with respect to the travel of said carriage platen and passing through said notches, said shift lever shaft being movable from a position where it shifts said axle arms so that said first roller platen is held in a lowered printing position with said first roller platen axle pressing upwardly on said lower segments of said pair of axle arms and said second roller platen is in a raised, idle printing position with said second roller platen axle pressing upwardly on said higher segments of said pair of axle arms and to a position where said first roller platen is in a raised, idle position and said second roller platen is in a lowered printing position, and stop means on said base to act against said shift lever shaft during travel of said platen carriage and thereby shift said shift lever shaft.

2. An improved apparatus for imprinting characters embossed on cards according to claim 1 and further including means for separately adjusting the vertical distance of each of said roller platen axles from said imprinting base so that distinct, legible printing can be obtained despite differences in the elevation of said printing elements.

3. An improved apparatus for imprinting characters embossed on cards according to claim 1 wherein said second printing element is a merchant plate attached to said imprinting base.

4. An improved apparatus for printing characters embossed on cards according to claim 1 wherein said shifting means for shifting said roller platens comprises a shift lever beam which is held rotatably on top of said platen carriage with a shift lever rigidly and perpendicularly attached to one end thereof and a shift lever balance post positioned parallel to said shift lever rigidly attached to the other end of the shift lever beam, said shift lever protruding downward through said platen carriage and holding said shift lever shaft into which said axle arms engage by means of said notches, each pair of said axle arms running in opposite directions toward and above said platen axles; the apparatus including two vertically oriented stops each stop attached to said base and positioned at a limit of said platen carriages' travel to abut against said shift lever; thus when said platen carriage reaches the limit of its travel said shift lever extending downwardly from said shift lever beam presses against one of the said vertically oriented stops thus moving said shift lever shaft so as to shift said lowered roller platen to said raised, idle position and said raised, idle roller platen to said lowered position capable of printing.

5. An improved apparatus for printing characters embossed on cards according to claim 1, wherein said means for adjusting the vertical distance of said roller platens from said base comprises four vertically oriented set screws, each of said set screws being positioned vertically so that each one of said platen axles presses upwardly against the tip of one of said set screws, the elevation of said roller platen axles from said imprinting base being individually controlled by said set screws.

6. An improved apparatus for imprinting characters embossed on cards according to claim 1 further comprising at least one additional printing element, each of said additional printing elements being positioned in the plane of said imprinting base so that one of said roller platens passes over said additional printing elements.

7. An improved apparatus for imprinting characters embossed on cards comprising a substantially flat imprinting base having on its upper surface a card holder for holding a first printing element consisting of a card with at least one line of embossed characters thereon, said base having on its upper surface at least one other printing element; a platen carriage mounted for reciprocal movement over said imprinting base and having at least one roller platen mounted rotatably on at least one roller platen axle mounted in said platen carriage, said printing elements being positioned on said base, control means in said platen carriage for controlling the elevation of said roller platens from said base so that said roller platens imprint characters from said printing elements when said platen carriage reciprocates over said imprinting base; at least one of said other printing elements having a charge printer for printing a number set by a charge setter, said charge printer comprising a plurality of digit wheels having raised digits on the rims of said wheels, a digit shaft mounting digit wheels so they are oriented in the direction of travel of said platen carriage, and said charge setter comprising means for accurately and reliably rotating and holding each digit wheel in a position where a particular digit faces upwardly thus selecting the digit to be printed; and means for clearing said charge printer after said platen carriage travels over said charge printer printing the amount of the charge therefrom;

wherein said charge setter further comprises a circular array of gear teeth attached to one of the sides of said digit wheels, said gear teeth engaging a pivotally mounted digit wheel gear segment, said gear segment being rotatable about said pivot by motion of a linear link, one end of said link being pivotally attached to said gear segment and the other end of said link being pivotally attached to a digit setter lever, said digit wheel being oriented for printing by positioning rotatably said digit setter lever, a curved digit cover mounted on said base through which said digit setter lever protrudes; and wherein said clearing mechanism comprises a downwardly directed cam mounted to one end of said platen carriage; a detent roller mounted rotatably on a pivoted detent lever and positioned so as to be activated by said cam on said platen carriage to disengage the spring-loaded detent levers from the gears of the digit wheels and to allow their free rotation on their return to zero, after said platen carriage has traveled over said charge printer; a clearing lever positioned adjacent and parallel to said charge setter and having one end pivotally mounted on the floor of said apparatus and the other end upwardly supported by a clearing lever spring fixed and held on said floor; a vertically oriented arch-shaped clearing lever yoke having two downwardly directed yoke legs, said clearing lever pivotally attached to said clearing lever yoke between said legs, said yoke positioned so that one of the roller guides of said platen carriage abuts and presses down said yoke when said platen carriage reaches the limit of its travel after printing from said charge printer; a substantially flat V-shaped clearing bar support pivotally mounted on said charge setter adjacent to the end of said clearing lever supported by said clearing lever spring, one end of said clearing bar support being pivotally connected to the end of said clearing lever supported by said spring; a clearing bar positioned perpendicular to and adjacent to each of said gear segments and attached to the end of said clearing bar support not connected to said clearing lever; thus when said roller guide abuts against and pushes down said clearing lever yoke, said clearing lever is forced downwardly and said clearing bar support rotates clockwise forcing said clearing bar to press against said gear segments and said digit wheels to rotate freely back to their original zero position thus clearing said charge printer.

8. An improved apparatus for imprinting characters embossed on cards comprising a substantially flat imprinting base having on its upper surface a first and a second printing element and mounted in the plane of said base a charge printer, said first printing element comprising a card having embossed characters thereon; a card holder for holding said card; a platen carriage mounted for reciprocal movement of said base over said printing elements and said charge printer; a first roller platen and a second roller platen, a first roller platen axle rotatably mounting said first roller platen to said platen carriage and a second roller platen axle rotatably mounting said second roller platen in said platen carriage in parallel transversely offset relation to said first axle; said first roller platen positioned to pass over and imprint from said first printing element and said charge printer and said second roller platen positioned to pass over and imprint from said second printing element; platen holding means for holding first one and then the other of said roller platens in a lowered position capable of imprinting characters during travel of said platen carriage over said base and simultaneously holding the other roller platen in a raised, idle position; shifting means automatically responsive to the travel of the platen carriage across said base for shifting said raised, idle roller platen into a lowered position capable of imprinting characters and said lowered roller platen simultaneously into a raised, idle position; adjustment means for adjusting the vertical elevation of each said roller platens separately from the surface of said imprinting base; said charge printer comprising a plurality of digit wheels having raised digits on the rim of each of said digit wheels, a digit shift mounting said digit wheels and being oriented in the direction of travel of said platen carriage, means for accurately and reliably rotating and holding each digit wheel to a position in which a particular select digit faces upwardly for printing; and a clearing means responsive to platen carriage movement for clearing said charge printer;

wherein said clearing means comprises a downwardly directed clearing bar cam attached to one end of said platen carriage; a detent roller mounted rotatably on a pivoted detent lever and positioned so as to be activated by said cam on said platen carriage to disengage the spring-loaded detent levers from the gears of the digit wheels and to allow their free rotation on their return to zero after said piston carriage has traveled over said charge printer; a clearing lever positioned adjacent and parallel to said charge setter and having one end pivotally mounted on the floor of said apparatus and the other and upwardly supported by a clearing lever spring held on said floor and adapted to engage slidably a perpendicular oriented cylindrical shaft; a vertically oriented arch-shaped clearing lever yoke having two downwardly directed yoke legs, said clearing lever pivotally attached to said clearing lever yoke between said legs, said yoke positioned so that one of the roller guides of said platen carriage abuts and presses down said yoke when said platen carriage reaches the limit of its travel after printing from said charge printer; a substantially flat V-shaped clearing bar support pivotally mounted on said charge setter adjacent to the end of said clearing lever supported by said clearing lever spring, one end of said clearing bar support having said cylindrical shaft attached thereto and said shaft being pivotally engaged by the end of said clearing lever supported by said spring; a clearing bar positioned perpendicular to and adjacent to each of said gear segments and attached to the end of said clearing bar support not engaged by said clearing lever; thus when said roller guide abuts against and pushes down said clearing lever yoke, said clearing lever is forced downwardly and said clearing bar support rotates clockwise forcing said clearing bar to press against said gear segments and said digit wheels to rotate freely to their original zero position thus clearing said change printer.

* * * * *